US006582587B1

(12) United States Patent
Srinivasan et al.

(10) Patent No.: US 6,582,587 B1
(45) **Date of Patent: *Jun. 24, 2003**

(54) CATHODIC PROTECTION DESIGN METHOD, CURRENT MAPPING AND SYSTEM

(75) Inventors: Rengaswamy Srinivasan, Ellicott City, MD (US); Periya Gopalan, Chandler, AR (US); Paul R. Zarriello, Catonsville, MD (US)

(73) Assignee: The Johns Hopkins University, Baltimore, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 855 days.

(21) Appl. No.: 08/799,923

(22) Filed: Feb. 13, 1997

Related U.S. Application Data

(60) Provisional application No. 60/011,778, filed on Feb. 14, 1996.

(51) Int. Cl.[7] ..... C23F 13/00

(52) U.S. Cl. ..... 205/724; 204/196.01; 204/196.06; 204/196.36; 204/404; 205/734; 205/775.5

(58) Field of Search ..... 204/196, 197, 204/404; 205/724–741, 775.5, 776, 776.5, 777

(56) References Cited

U.S. PATENT DOCUMENTS

| | | | | |
|---|---|---|---|---|
| 4,051,436 A | * | 9/1977 | Weir | 204/404 |
| 4,623,434 A | * | 11/1986 | Nicholson et al. | 204/404 |
| 5,087,873 A | * | 2/1992 | Murphy et al. | 205/775.5 |
| 5,466,353 A | * | 11/1995 | Westermann et al. | 204/196 |
| 5,674,375 A | * | 10/1997 | Thompson | 204/196 |

* cited by examiner

*Primary Examiner*—T. Tung
(74) *Attorney, Agent, or Firm*—Francis A. Cooch

(57) ABSTRACT

Numerical techniques such as the finite element method (FEM) are used to model the current and voltage distribution in concrete structures such as bridges. The geometric arrangement of groundbeds and the ideal locations for the electrical contacts vis-a-vis the geometry of the bridge and the rebars can thereby be predicted and a cathodic protection (CP) system for the bridge designed. A magnetic sensor is used to sense the magnetic field generated by the CP current, and a voltmeter or an oscilloscope to measure the output of the magnetic sensor. A current interrupter is also used to interrupt the CP current at the source. The current is mapped by placing the magnetic sensor on or above the concrete surface. By moving the sensor from one location to another, the current is mapped over the entire structure. To achieve uniform distribution over the entire structure, an "expert" CP system controlled by a variety of current and environmental sensors and a dedicated microprocessor is described.

5 Claims, 13 Drawing Sheets

7

CATHODIC PROTECTION DESIGN METHOD, CURRENT MAPPING AND SYSTEM

CROSS-REFERENCE TO RELATED APPLICATION

This application claims the benefit of prior filed U.S. provisional application serial No. 60/011,778, filed Feb. 14, 1996.

STATEMENT OF GOVERNMENTAL INTEREST

This invention was made with Government support under Contract No. N00039-95-C-0002 awarded by the Department of the Navy. The Government has certain rights in the invention.

BACKGROUND OF THE INVENTION

The invention relates to cathodic protection (CP) systems and, more specifically, to a method for designing CP systems, to a method and apparatus for mapping the distribution of CP current on concrete structures and to an "expert" cathodic protection system.

Cathodic protection is a popular technique that is commonly used to minimize corrosion of metals in a wide variety of large structures including, bridges, pavements, parking lots and pipelines. This technique is based on the principles of electrode kinetics, which can be briefly described as follows. In the absence of any polarization, a metal in contact with concrete or an electrolyte will remain at its corrosion potential ($E_{cor}$). At this potential, the metal surface sustains at least two reactions occurring at equal rates: a metal dissolution (or anodic metal oxidation) reaction, and a cathodic conjugate reaction, such as oxygen reduction or hydrogen evolution.

If the metal is electrically polarized to potentials positive to $E_{cor}$, the metal dissolution reaction will be accelerated, while the cathodic conjugate reaction will be decelerated. The converse is true when the metal is polarized negative to $E_{cor}$. Thus, when the metal is polarized away from $E_{cor}$ to a positive or negative value, a net anodic or a net cathodic current, respectively, will flow across the metal/electrolyte interface. A metal is said to be under cathodic protection (CP) when it is polarized sufficiently negative to $E_{cor}$ to reduce the metal dissolution rate by three orders of magnitude or more. Under most conditions, a polarization of about −200 to −300 mV is sufficient to achieve cathodic protection.

Excessive cathodic polarization should be avoided to prevent onset of hydrogen evolution reaction, and to reduce the possibility of hydrogen embrittlement of the metal. Furthermore, cathodic polarization, like corrosion, is a surface process. Therefore, to achieve uniform protection at all locations on a given surface, it is imperative that the cathodic current density is uniform at all locations. Any nonuniformity in the current flow, especially with values less than some critical minimum, can cause localized variations in the metal dissolution rate. This can result in the structure corroding more severely in some places than in others. In a bridge, for example, if the CP current is nonuniformly distributed, those parts of the bridge that do not receive the current will continue to corrode, while those that do receive CP current will be well-protected from corrosion.

In typical CP systems used in protecting metal-concrete structures, the metal is usually steel, and the cement and water form the electrolytic medium. Generally, the CP system has a rectifier as the voltage source. The return electrode for the current is either a palladium-coated titanium mesh, a thin layer of zinc, or a conducting polymer mixed with concrete. They are "inert" electrodes, not consumed or destroyed by the reactions associated with the cathodic protection, and are called ground beds. Generally, the ground bed is two-dimensional, is spread over the entire structure, and is covered with concrete and asphalt.

In concrete structures, CP is used to protect the reinforcing steel bars, commonly referred to as rebars, from corrosion. On bridge structures, CP has traditionally been used to protect only the deck sections, but recently, support structures have also been protected. In general, all the rebars are electrically connected to one another, and the electrical connections between the rebars and the rectifier are made at one or two remote locations on the bridge. Similarly, the electrical connections between the ground-bed and the rectifier are also made at one or two remote locations. Thus, in most cases, the ground-bed is distributed evenly with respect to the rebars; however, the electrical contact points are highly localized.

During the past 30 years, federal and state highway administrations have been testing and assessing the merits of the CP technique. As a part of that initiative, over 350 bridges in North America are now under CP. Most of these bridges are located in a wide variety of geographical locations, from Washington to Maryland, and Florida to New York. Several more bridges in Canada, with approximately 60 in the Quebec Province alone, are also under CP. Thus, intended or not, they are exposed to a wide variety of environmental and climatic conditions.

If the past 30 years of history were considered as the first step toward exploring CP as a viable technique to protect bridges from corrosion, then the results from those studies are somewhat mixed at best. During the past 10 years, there has been a profusion of reports on the status of CP in several state and federal bridges. These reports suggest that cathodic protection has had mixed success and appears to be more effective on some bridges, as compared to others. The causes of failures have been attributed to a variety of reasons, ranging from inadvertent shutdown of the rectifiers to improper electrical connections. Studies correlating climatic and environmental factors to the effectiveness of CP have yet to appear in any published literature. In essence, the CP technique for concrete structures is still evolving.

The future of cathodic protection (CP) as applied to rebars in concrete bridges is strongly dependent upon the design of CP systems. The design, in turn, determines the effectiveness of CP in minimizing corrosion and the cost of implementation and maintenance. The major drawback of contemporary designs has been excessive flow of CP current in some parts of the bridge, and little or no current in-others.

The use of sensors to manage CP systems in concrete structures is also evolving. Earlier designs used potential-measuring sensors, such as reference half-cells, to monitor the level of electrochemical potential drop across the rebar/concrete interface. In practice, these sensors can only be kept at a finite distance from the interface; hence, a large resistive drop due to the resistance of the concrete is always included as part of the measured potential. This condition has posed serious limitations on both monitoring and maintaining appropriate levels of CP for the rebars. Besides, using potential to monitor CP systems requires measurements to be made at short intervals, i.e., 4 ft or less. This situation could mean installation of virtually hundreds of reference electrodes, especially for large structures such as bridges.

The installation cost of cathodic protection systems on a bridge is reportedly in the range of 15% of the cost of the construction of the bridge. In addition, the recurring expenses due to maintenance and management of CP over its lifetime can increase its cost by several fold. Therefore, in the future, the use of CP techniques is likely to be determined as much by cost considerations, as by its technical merits. There is a need for options to reduce design and installation costs, as well as maintenance and management costs.

SUMMARY OF THE INVENTION

The primary goal of the invention is to achieve a uniform distribution of current over an entire structure at all times. To achieve such uniform distribution, the invention provides for an "expert" CP system controlled by a variety of current and environmental sensors and a dedicated microprocessor. The invention also includes: (1) development of numerical techniques that can be used in CP system designs; (2) remote sensing and mapping of the distribution of CP currents in bridges; and (3) correlating the effect of micro-climatic changes to the distribution of CP currents.

The invention uses numerical techniques such as the finite element method (FEM) to model the current and voltage distribution in concrete. The geometric arrangement of ground-beds and the ideal locations for the electrical contacts vis-a-vis the geometry of the bridge and the rebars can thereby be predicted.

The current mapping aspect of the invention uses a magnetic sensor to sense the magnetic field generated by the CP current, and a voltmeter or an oscilloscope to measure the output of the magnetic sensor. The invention also uses a current interrupter to interrupt the CP current at the source.

The current is mapped by placing the magnetic sensor on or above the concrete surface. The current is also mapped by burying the magnetic sensor inside the concrete. The sensor is surrounded by air, concrete, water or other solids or fluids during the measurement. By moving the sensor from one location to another, the current is mapped over the entire structure. Unlike monitoring the potential, as discussed above, mapping the current does not involve errors from resistive drops, and, as described, only a very few sensors are needed to monitor CP.

DETAILED DESCRIPTION

Figure 1:
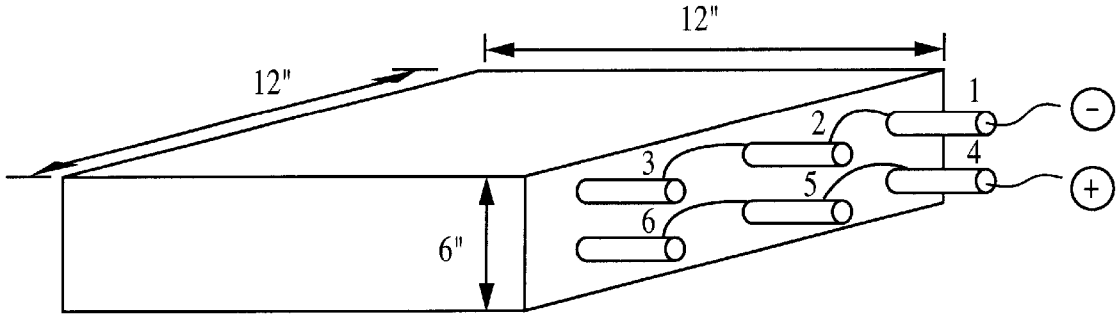
FIG. 1 illustrates a schematic representation of a model concrete block.

There are several steps one can take to improve the CP technique designed/manufactured/used at present. Computer modeling of current and voltage distribution and mapping of the current distribution are the two most important steps in the design and practice of cathodic protection.

The CP system can now be designed more efficiently than in the past, with greater emphasis on uniform distribution of current and potential throughout the bridge. Using numerical techniques such as the finite element method (FEM), one can model the current and voltage distribution in concrete and thereby predict the geometric arrangement of ground-beds and the ideal locations for the electrical contacts vis-a-vis the geometry of the bridge and the rebars. Variations in the electrical conductivity of the concrete overlayers, the presence of coated and uncoated (bare) rebars; and spatial variations in the level of exposure to moisture and salt can all be easily incorporated into the CP design.

The FEM analysis used in numerical simulations can be conducted both in two and in three dimensions. A wide range of dimensions, from the large size of a bridge deck to the fine thin coating on rebars can be incorporated simultaneously in FEM models. Linear and nonlinear properties of electrical conductivities (as in the cases of metal and metal/electrolyte interface) can also be simultaneously incorporated in them. Similarly, different kinds of materials properties can all be included in the models. The FEM analysis can be used to simulate potentiostatic (constant potential) or galvanostatic (constant current) conditions that are present in CP systems. FEM analysis can be used to predict potential, current and magnetic field distributions in cathodically protected concrete structures. Furthermore, after implementation, the validity of the FEM results can be verified through mapping of the CP current over the entire bridge.

CP current mapping can be done using fluxgate magnetometer sensors. These sensors are lightweight instruments and can be powered by batteries. They are totally isolated and insulated from their surroundings, and can be operated while buried in concrete, immersed in water, or left under any condition that surrounds bridges. They are able to measure AC and DC currents and are vector instruments, that measure both amplitude and flow direction of the current. Their spatial resolution decreases with the increase in the liftoff distance between the sensors and the rebars; when the sensor is 4 inches away from the rebar (which is the typical distance between the rebars and the top or the bottom surface of the concrete), it will measure the current that is present over a 8-inch length of the rebar.

Note that magnetic sensors are not reference half-cells; they are not used to measure polarization potentials, and are not limited by resistive or iR drop across the concrete resistance. These properties of the sensors are quite useful in measuring and mapping localized distribution of the CP current, which capability is the most important feature of the magnetometer sensor, with respect to optimizing CP in large extended structures.

As the first step toward using computer simulation and current mapping on in-service bridges, the concept of optimizing CP system designs was verified in two different tests. The first test utilized a small, steel-reinforced, 12"×12"×6" block of concrete. The block (FIG. 1) contained two layers of six #5 rebars (0.625-in. diameter), three on top and three on the bottom. These rebars were bare; each was 14" long, with 12" buried inside the concrete, and 2" (1" on each side) projecting outside the concrete. The three rebars in the top layer (Rebars 1, 2 and 3) were shorted to each other. The three rebars in the bottom layer (Rebars 4, 5 and 6) were also shorted to each other. The rebars on the top layer were cathodically polarized, while the rebars in the bottom layer were used as the ground return, under two different configurations described below. The objective was to identify the effect of the electrical contact configuration on the distribution of the CP current.

Figure 2A:
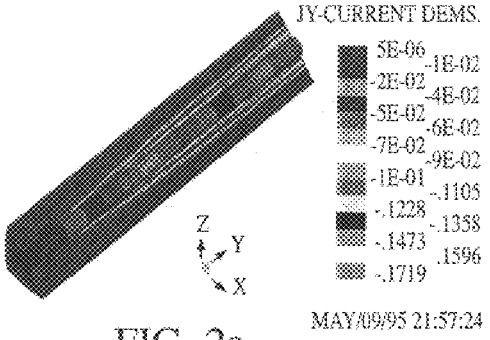
FIG. 2, consisting of FIGS. 2*a* and 2*b*, illustrates, in FIG. 2*a*, the cathodic protection current for an asymmetric electrical configuration, as determined-by FEM analysis, that is present on one of the rebars in the concrete block of FIG. 1, and, in FIG. 2*b*, the current between the rebar and the concrete.
Figure 2B:
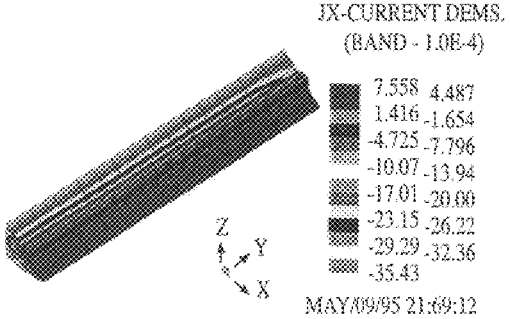

In an asymmetric electrical configuration, Rebar 1 in the top layer was connected to the negative terminal of the voltage source. Rebar 4 in the bottom layer was connected to the positive terminal. The resulting currents determined by the FEM analysis are shown in FIGS. 2*a* and 2*b*. FIG. 2*a* shows the CP current that is present on one of the rebars in the block. The current between the rebar and the concrete is shown in FIG. 2*b*. The magnitude of the current is maximum at that end of the rebar which has the electrical contact, and minimum at the end far away from it.

Figure 3:
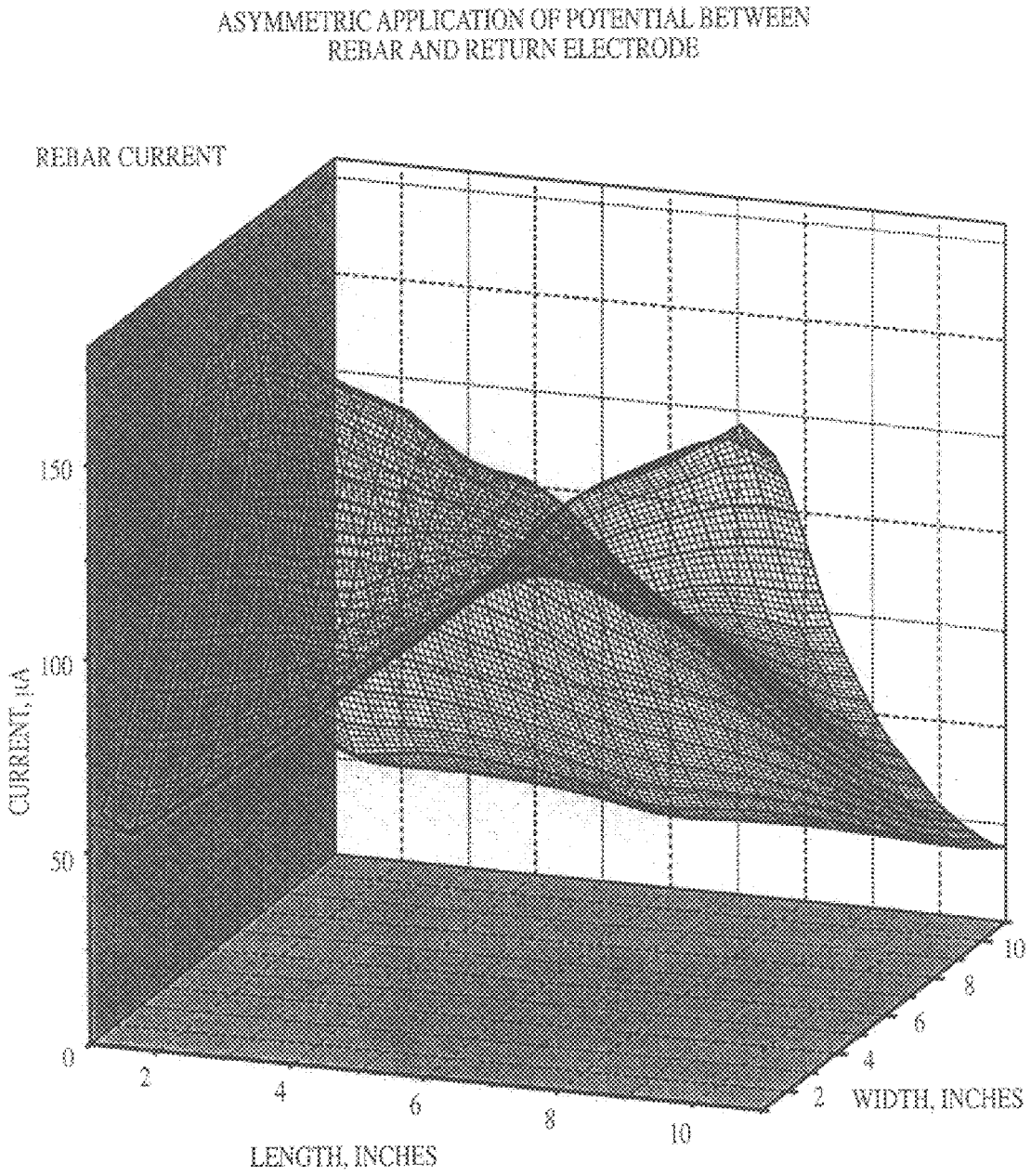
FIG. 3 illustrates a current map produced by the invention for the asymmetric electrical configuration of FIG. 2.

The current map, obtained using a magnetic sensor on the actual concrete block is shown in FIG. 3, which also shows that the current is unevenly distributed over the block. Clearly, both the numerical simulation and the experimental data show that although the rebars are good electrical conductors (relative to concrete), the choice of asymmetric electrical contact to them can cause a large flow of electrical current in one end of the rebar, and relatively much less at the other end. What is most surprising is that nonuniformity can occur even when the size of the concrete block is as small as 12"×12"×6".

The only way that the observed asymmetry can be explained is that: (1) the current is limited by the resistance due to concrete; (2) currents tend to go through the path of least resistance; and (3) the path close to the contact points, perhaps, is least resistive. In order to test this hypothesis, we repeated the experiment using a symmetric electrical connection, as described below.

Figure 4A:
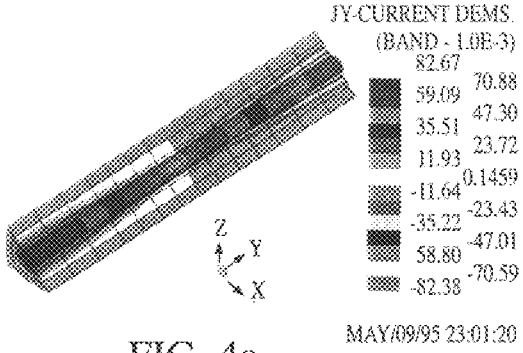
FIG. 4, consisting of FIGS. 4*a* and 4*b*, illustrates, in FIG. 4*a*, the cathodic protection current for a symmetric electrical configuration, as determined by FEM analysis, that is present on one of the rebars in the concrete block of FIG. 1 and, in FIG. 4*b*, the current between the rebar and the concrete.
Figure 4B:
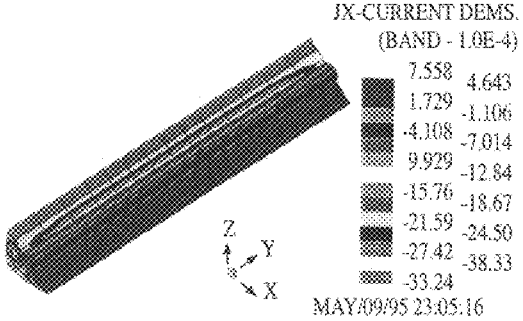
Figure 5:
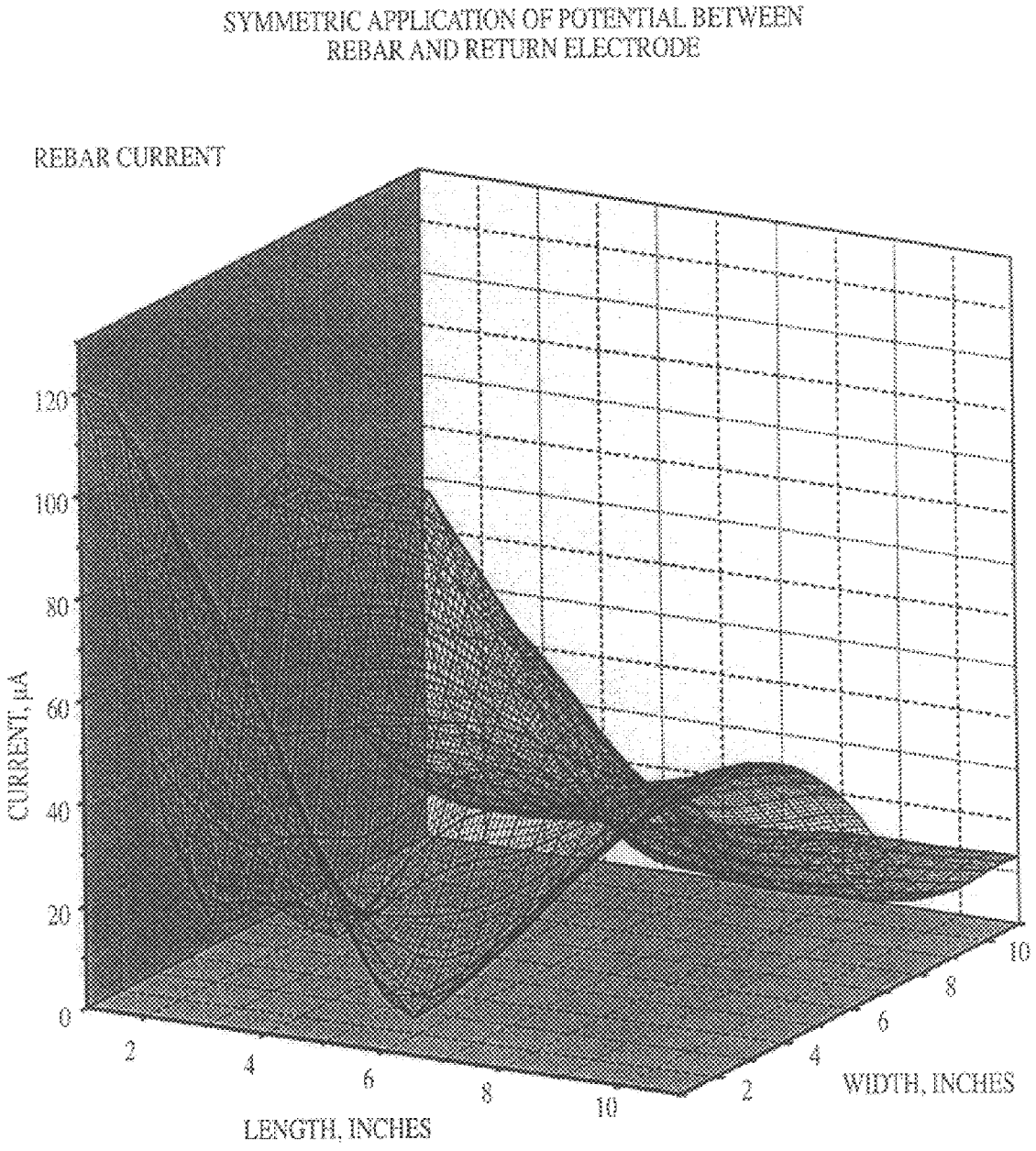
FIG. 5 illustrates a current map produced by the invention for the symmetric electrical configuration of FIG. 4.

In a symmetric electrical configuration, Rebars 1, 2 and 3 were all connected on both ends to the negative end of the power source. Similarly, Rebars 4, 5 and 6 were all connected on both ends to the positive end. As in the asymmetric case, the current distribution was determined by numerical simulation, and direct mapping was done with a magnetometer. The results of the FEM analysis are shown in FIGS. 4*a* and 4*b*. The current mapped with the sensor. is shown in FIG. 5. Both the simulation and direct mapping show a fairly uniform distribution of current in the rebars and block.

The second test again utilized a small, steel-reinforced block of concrete, 4.0×3.0×0.8-ft. in size. The block (FIG. 6), which represents a small section of a bridge deck, also contained two layers of No. 5 rebars (0.625-in. dia.), oriented orthogonally to each other. Each rebar extended over the entire length of the concrete block, and each layer of the rebars was parallel to the plane of the concrete. The two layers of the rebars were 5.5 in. and 6.5 in. below the top surface of the concrete overlay. A metallized layer depicting the anode mesh was incorporated between the rebar layers and the top surface of the block. The metallized layer was covered with a layer of asphalt. Resistivity values of $0.18\times10^{-4}\Omega\cdot$cm., $0.1\times10^{5}\Omega\cdot$cm and $0.5\times10^{5}\Omega\cdot$cm were assigned for the steel, asphalt and concrete, respectively.

Figure 6:
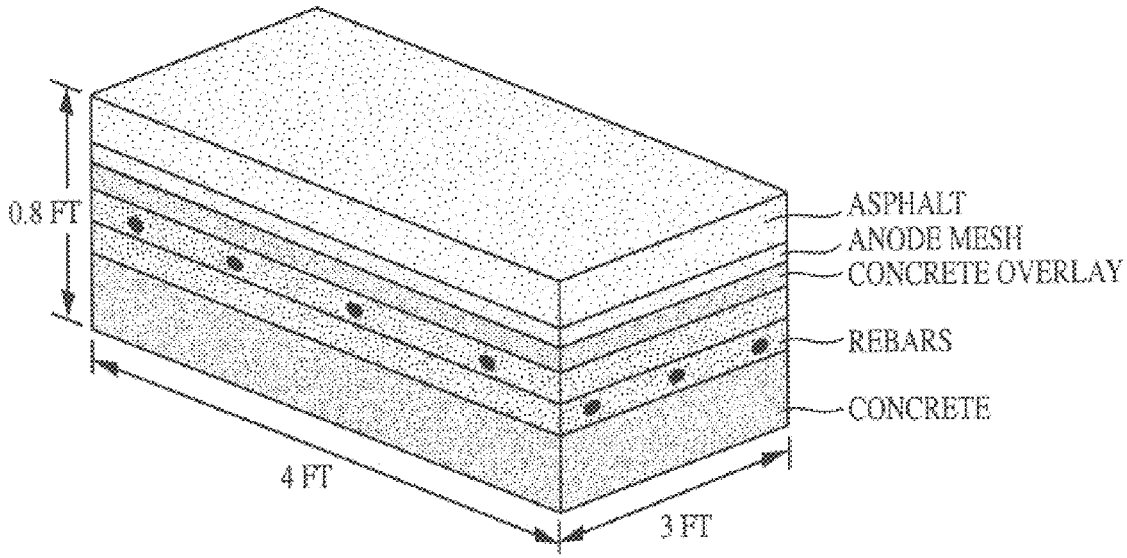
FIG. 6 illustrates a schematic representation of a model concrete block which represents a small section of a bridge deck.

The surfaces of the rebars that are shown as circles in FIG. 6 were specified with identical electrical potential; this setup is equivalent to connecting the rebars electrically to the same source and polarity. The other ends of the rebars (not visible in FIG. 6) were not specified with any potential. Similarly, the surface of the metallized layer that is projecting out of the concrete surface was specified with an electrical potential of opposite polarity to that of the rebar surface.

Electrical conductivity values, commonly known for steel, concrete, asphalt and steel/concrete interface, were also incorporated into the model. In essence, these parameters simulate a cathodically protected concrete surface, where the rebars are polarized cathodically and the metallized layer is polarized anodically. Furthermore, specifying the electrical voltages at only one end of the rebars (and the metallized layer) simulates an asymmetrical electrical contact, which is the most common practice used in the field on in-service structures. The objective of the simulation is to identify the effect of the asymmetrical electrical contact configuration on the distribution of the CP current and potential.

In electrochemistry and corrosion, the terms "voltage" and "potential" are not interchangeable. Whereas voltage refers to the electrical voltage applied between the rebars and the ground bed, potential refers to the potential drop incident across the rebar/concrete (metal/electrolyte) interface. This potential is not caused by a pure electrical drop alone, but by the sum of the differences in the electrical and chemical potentials between the metal and the electrolyte; it is commonly referred to as the electrochemical potential. That is the reason why electrochemical reactions, including corrosion, are affected by the chemical composition of the electrolyte (pH, oxygen concentration, ionic strength, and so on), as well as by electrical potentials (as in cathodic polarization). The term, electrochemical potential, is often loosely referred to as potential. However, since there is nothing like a chemical voltage, terms such as "electrochemical voltage" or its shortened form "voltage" are not used to refer to the potential drop across the steel/concrete interface.

Figure 7:
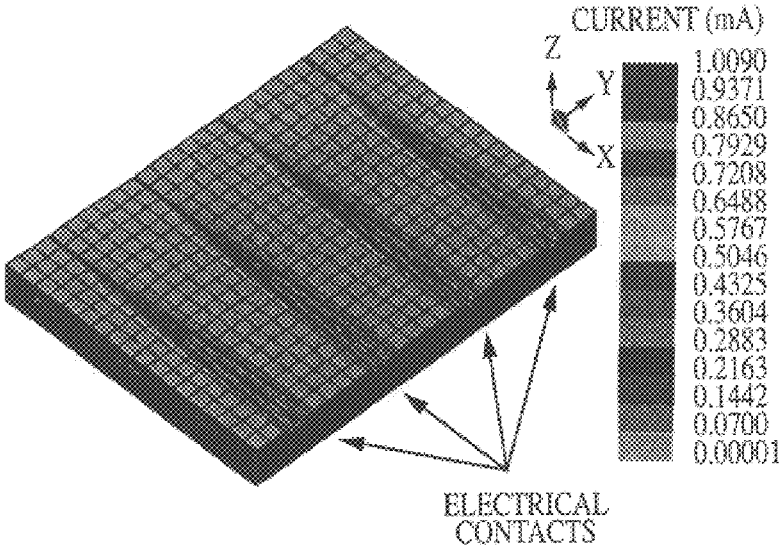
FIG. 7 illustrates the current distribution near the rebar/concrete interface for the top layer of rebars, as determined by FEM analysis, for the model structure of FIG. 6.

The current distribution near the rebar/concrete interface for the top layer of rebars, obtained by the FEM analysis for the model structure in FIG. 6, is shown in FIG. 7. The rebar surface where the electrical contacts were made is also indicated in FIG. 7. The magnitude of the current is maximum at the end of the rebar surface where the electrical voltage was specified and is minimum at the far end.

Figure 8:
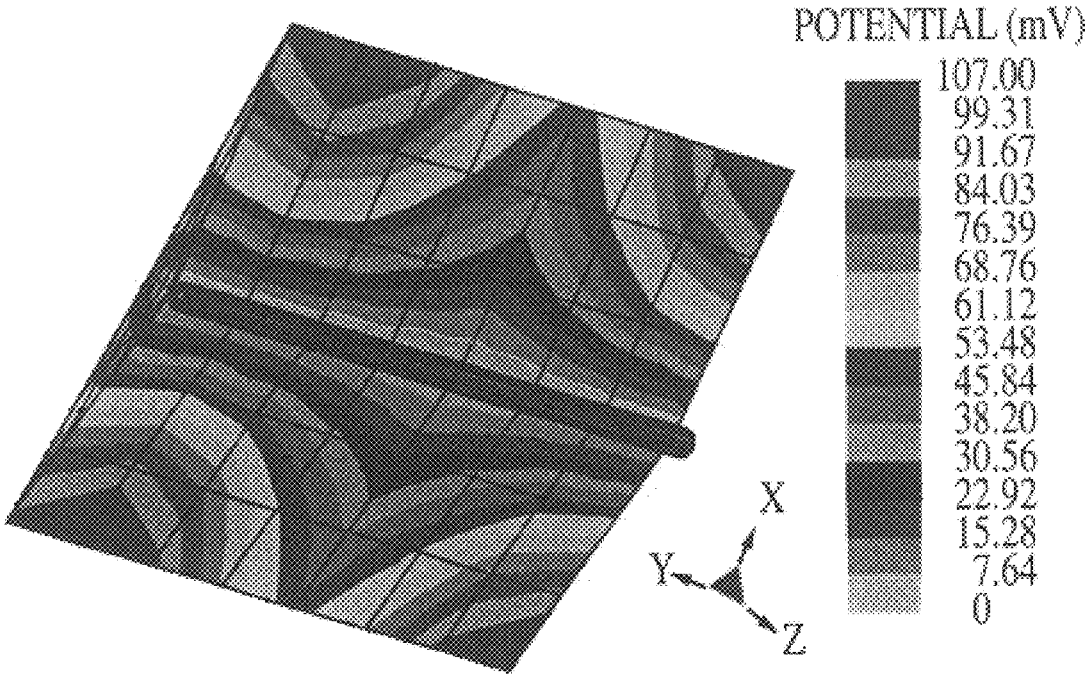
FIG. 8 illustrates the potential distribution near a small section of a rebar/concrete interface, as determined by FEM analysis, for the model structure of FIG. 6.

The potential distribution at a location close to one of the rebars is shown in FIG. 8; the spacing of the grids in this figure is on the order of centimeters. Close to the rebar/concrete interface, the drop in the potential is relatively small; most of the drop occurs over a distance of a few centimeters within the concrete. At all other locations of the interface, the potential distribution was found to be nearly identical to the one shown in FIG. 8. The relatively larger drop in the concrete is commensurate with its higher resistivity ($0.5\times10^{5}\Omega\cdot$cm) in comparison with steel ($0.18\times10^{-4}\Omega\cdot$cm).

As with the first test, a significant conclusion drawn from the FEM analysis is that for asymmetrical geometric configurations (of the rebars and the ground bed), with asymmetrical electrical configurations, the rebar/concrete interface that is father away from the electrical contacts receives very little current. As described above, the degree of protection from corrosion is reduced as the current across the interface is reduced.

Obviously, CP designs similar to the one described previously, if adapted for a real concrete structure, may not protect the rebars from corrosion over their entire length. Several of the 350 bridges mentioned previously, and many other structures that are presently under-cathodic protection, are protected using asymmetrical electrical connections. An example of the effect of such protection on symmetrical geometric structure, under real field conditions, was demonstrated through current mapping on an in-service bridge in Maryland.

Figure 9A:
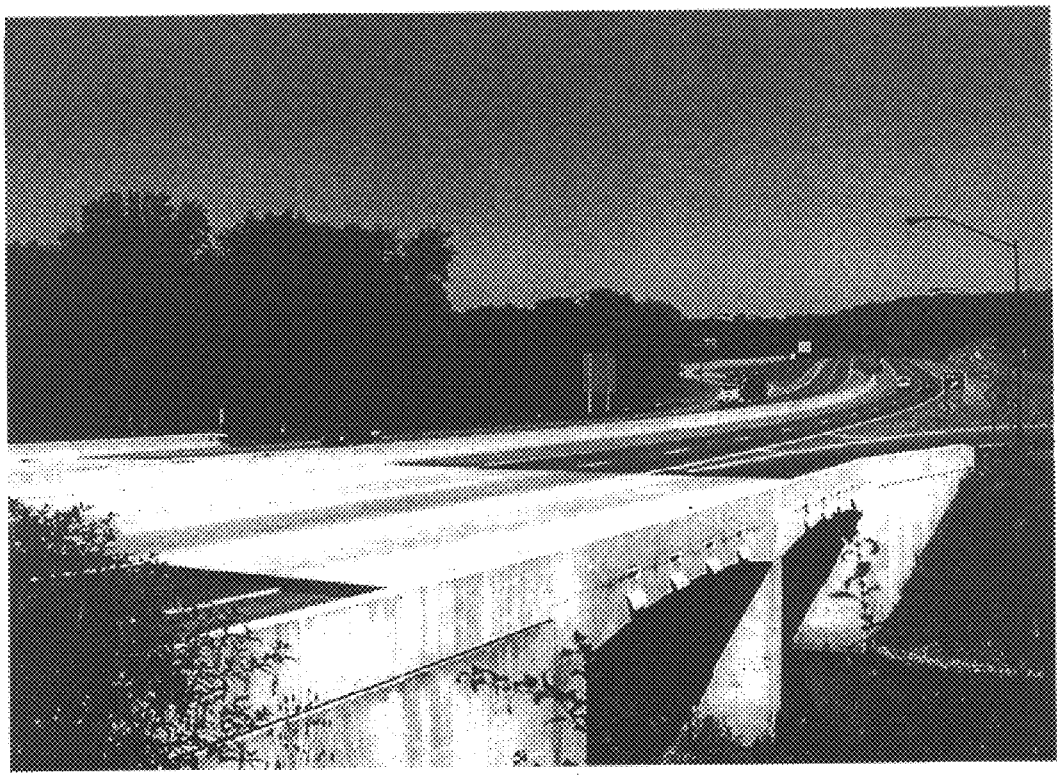
FIG. 9, consisting of FIGS. 9*a* and 9*b*, is, in FIG. 9*a*, a photograph of an actual steel-reinforced concrete bridge located in Maryland, and, in FIG. 9*b*, a schematic of the same bridge.
Figure 9B:
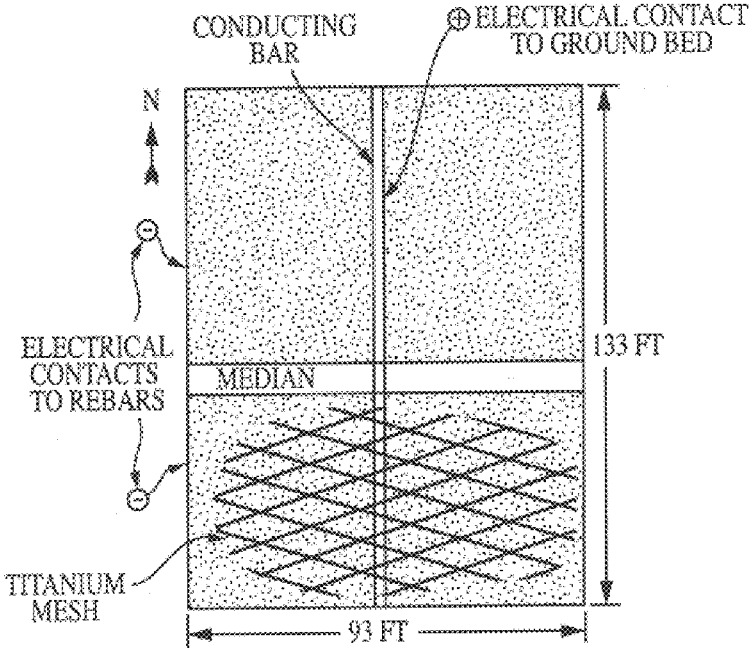

FIG. 9*a* shows a steel-reinforced concrete bridge located in Maryland. The schematic of the bridge is shown in FIG. 9*b*. The bridge is 93 feet long in the east-west direction and 133 feet wide in the north-south direction. The bridge deck is cathodically protected by a single rectifier. The deck has two layers of uncoated rebars, one on top, and the other on the bottom, with concrete in between. All rebars are shorted to one another.

A mixed metal-oxide titanium mesh, spread over the entire bridge, is placed over the top layer of the rebars, and acts as the ground return. A latex-concrete mix covers the titanium mesh. A 133-foot long conducting bar, which runs along the north-south axis, placed at about 46 feet from the west end of the bridge, is connected to the titanium mesh.

A point contact made to the conducting bar at about 60 feet from the north end of the bridge, is connected to the positive terminal of the rectifier. The negative terminal of the rectifier is connected to the rebars at two locations along the west end of the bridge. Thus, the bridge is a textbook combination of a uniformly distributed ground return laid over a uniformly distributed rebars, with the non-textbook condition of remote electrical connections.

Figure 10:
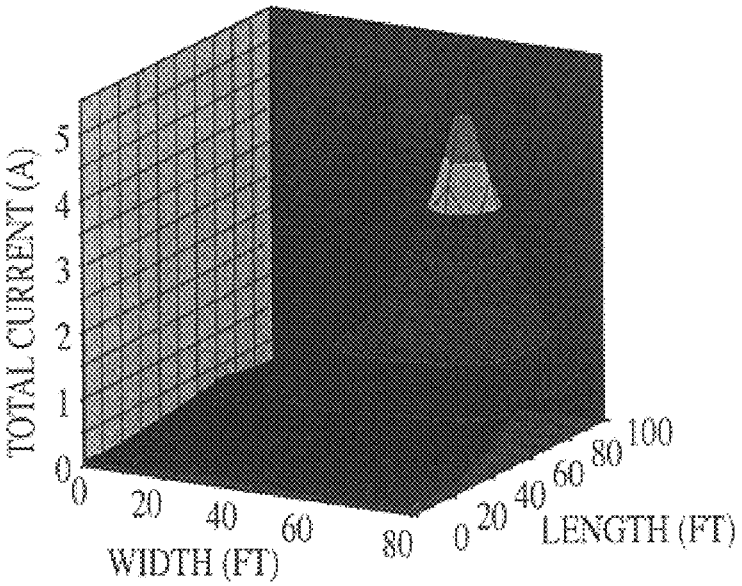
FIG. 10 illustrates the CP current distribution of the bridge of FIG. 9.

CP currents were mapped from the top of bridge deck. For this purpose, the deck was divided into a matrix of several parallel and perpendicular lines at intervals of 10 feet. At each intersection of these lines, the currents flowing along the east-west axis and the north-south axis were measured using magnetometer sensors. The resulting current map is shown in FIG. 10. Note that FIG. 10 shows only an 80×80-foot part of the 93×133-foot area of the bridge deck; the amplitude of the CP current in the rest of the deck is less than 1$\mu$A.

The CP currents are concentrated only in the northwest part of the bridge, where they reach a peak value of about 5 A. The location where the maximum current occurred matches well with one of the points where the rebars are connected to the rectifier. This current distribution also confirms that while the distributed geometry of the ground return, namely a mesh spread over the entire deck, appears intuitively correct, it did not help achieve uniform current distribution. The CP current mapped with magnetometer sensors over the entire deck of the bridge shows that more than 60% of the area did not receive any current.

Figure 11:
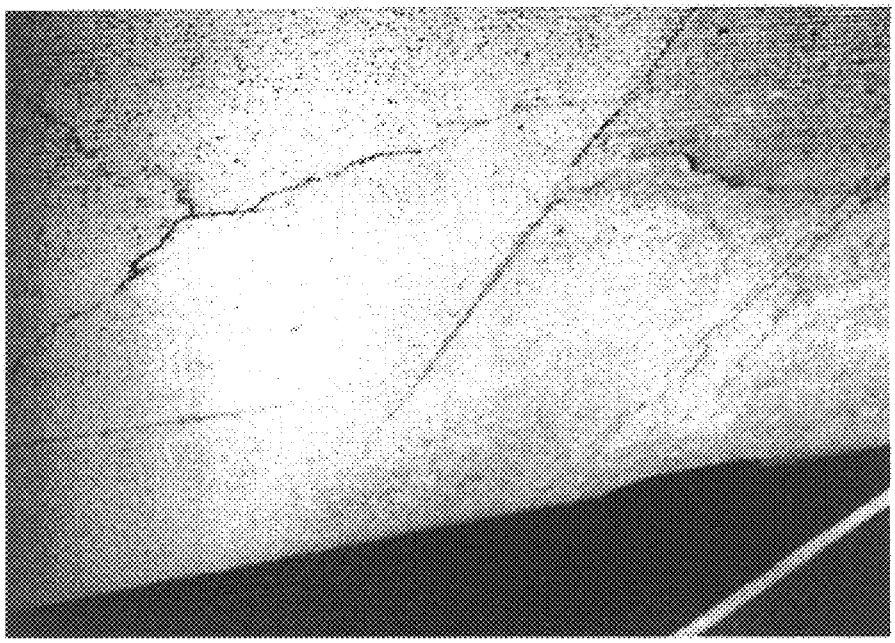
FIG. 11 illustrates cracks found on the bridge of FIG. 9*a*.

Visual observation made on the top and the bottom of the deck revealed a significant amount of cracks in the structure in the east and the southeast locations (FIG. 11). FIG. 10 shows that these regions received little or no CP current. The northwest locations that received significantly larger currents showed no evidence of cracking. It is possible that in the east and the southeast locations, the rebars are corroding because of a lack of cathodic current. Direct confirmation of the corrosion of the rebars through visual inspection is yet to be obtained. If the rebars are indeed corroding, that could be causing spalling and cracking of the concrete.

The CP current distribution on a prestressed concrete bridge on Abbey Drive in Cleveland, Ohio was also mapped over a period of about six hours. This bridge has been CP protected under a program sponsored by the Federal Highway Administration. On this bridge, in addition to mapping the current on the steel-reinforcing bars, for the first time, the current flowing between the rebars and concrete was also computed.

Figure 12A:
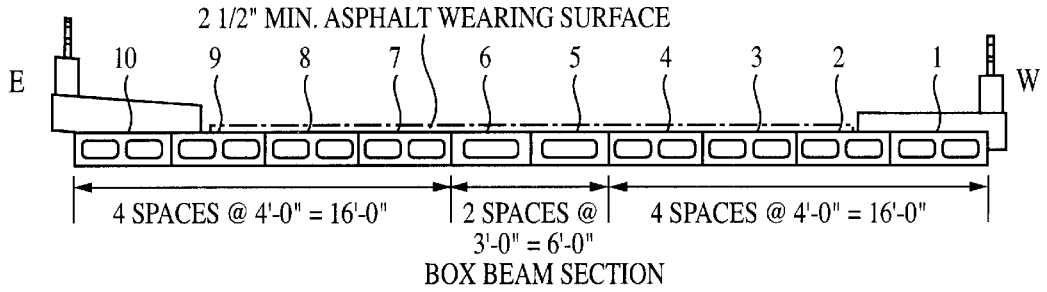
FIG. 12 illustrates a schematic of an actual bridge located in Cleveland, Ohio.
Figure 12B:
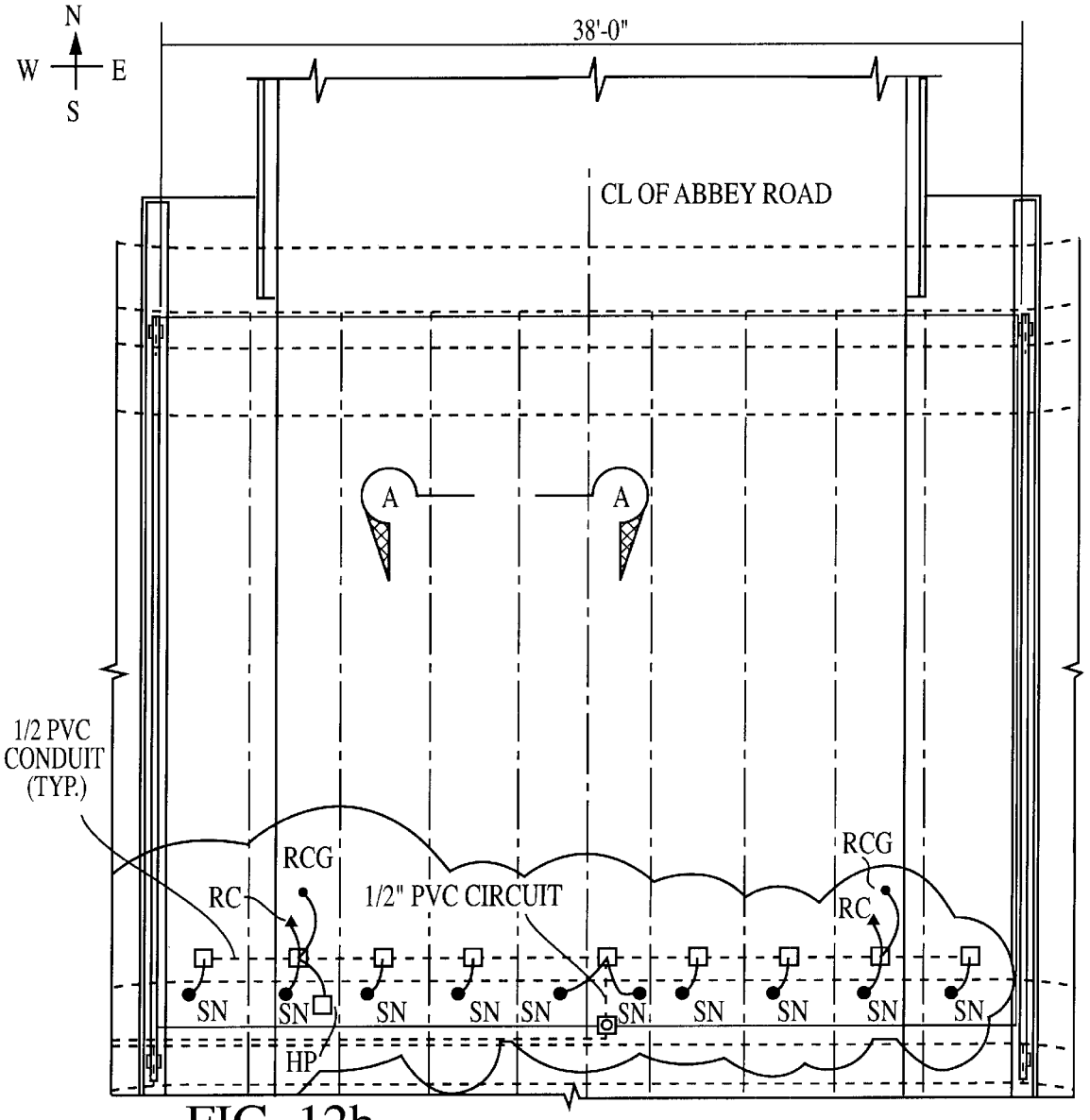

The bridge (FIG. 12) is 38-feet wide (east-west axis), and 30 feet long (north-south axis). The bridge structure is a box-beam construction, with 10 boxes in all. Each box is 30 feet long in the north-south axis. The 10 boxes are placed next to each other along the east-west axis. Eight of the 10 boxes are 4 feet wide; two boxes, placed around the middle of the east-west axis of the bridge, are each 3 feet wide. The asphalt overlay on the top surface of the 10 boxes should be expected to make an ionic (electrolytic) contact between all the boxes.

The bottom of the bridge is coated with zinc. A 38-foot long and 0.5-inch wide titanium strip is placed across the width (east-west axis) of the bridge, on the top of the zinc coating; this strip is located 6.5 feet from the south end of the bridge. The titanium strip provides electrical contact between the zinc coating on all the boxes. A rectifier is placed near the south-west end of the bridge. The positive terminal of the rectifier is connected to a single location on the titanium strip approximately 20 feet from the west and 7 feet from the south ends of the bridge. The negative terminal of the rectifier is connected distributively to each box; the actual contact is made to the reinforcing bars (in each box) at a distance of about one foot from the south end of the bridge. The rectifier operates at about 2.5 V, and 150 mA DC. Items marked as RC and HP in FIG. 12 refer to Reference Cell and Hydrogen Probe, permanently installed in the bridge structure, and were not used during the test.

The current on the bridge was mapped using two triaxial magnetometer sensors. These sensors measure the magnetic field produced by the current in the bridge. Current maps made with the rectifier connected to the bridge showed that the rectifier was impressing a low-frequency stray current noise on the bridge; the magnitude of the stray current noise was comparable to the magnitude of the CP current. The stray current was absent when the bridge was totally disconnected from the rectifier. To avoid the stray current problems while mapping the current, an independent voltage source, isolated from the main power, was use. This source was free of stray current noise and operated at 1 V and 180 mA. The currents were mapped from the lower side of the bridge in intervals of four feet or less over the entire length and width of the bridge, using 2 triaxial magnetometers.

Figure 13:
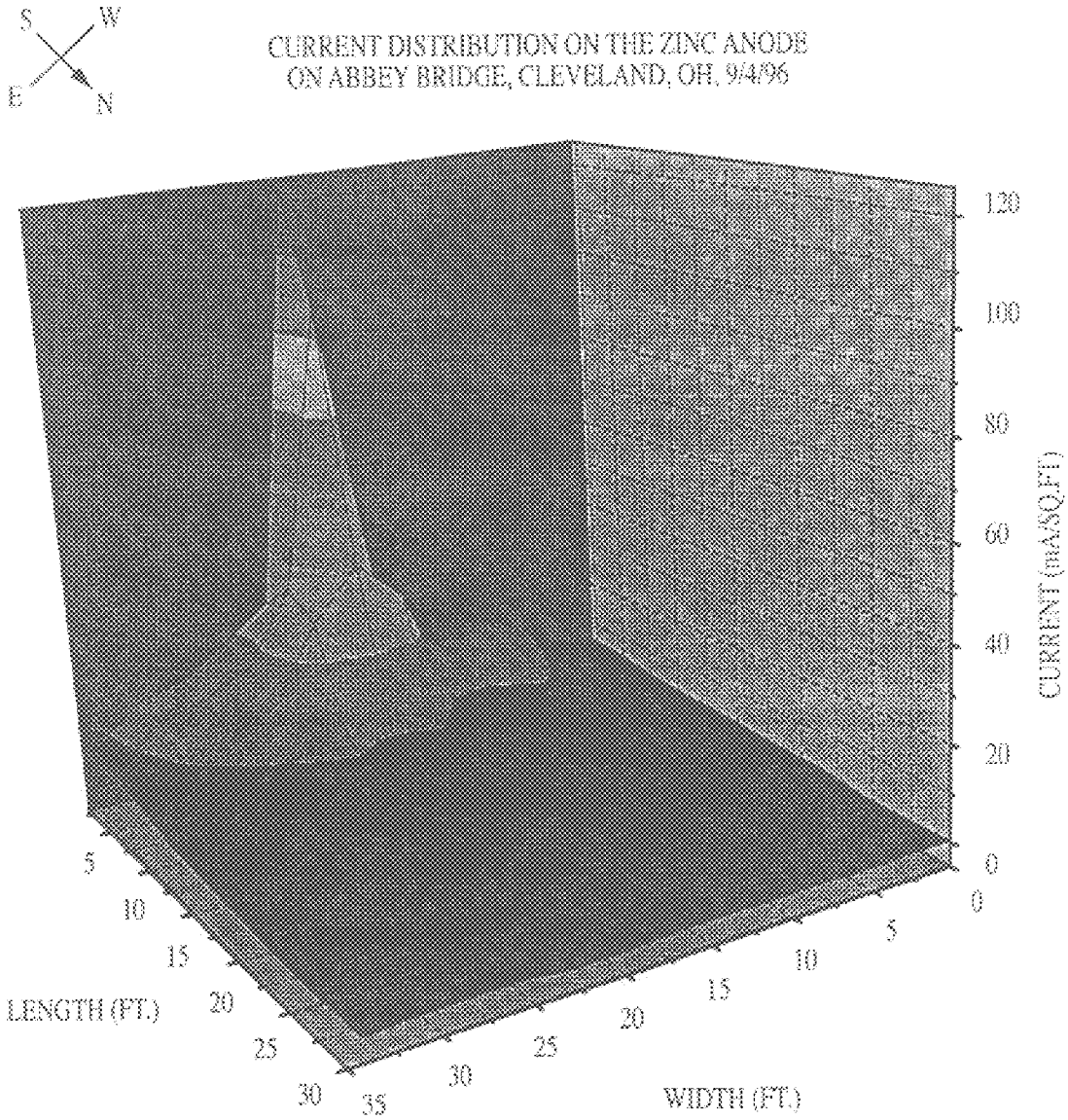
FIG. 13 illustrates the current distribution of the zinc anode of the bridge shown in FIG. 12.

The magnetic field due to the CP current present on the rebars and zinc anode was measured at 88 different, evenly spread locations over the 30-ft ×38-ft area of the bridge. The magnetic field data was normalized for direction and depth and converted into CP current on the zinc anode, as well as rebar-to-concrete current. The CP current present on the zinc anode is shown in FIG. 13. The rebar-to-concrete current is shown in FIG. 14*a* (full view of the bridge), and in FIGS. 14*b* and 14*c* (enlarged views of the-sections that receive substantially small and substantially high amounts of the current, respectively).

FIG. 13 shows that the current on the zinc anode is nonuniform. More importantly, between they 0 and 10-foot locations along the length (north-south axis) of the bridge, the current on the zinc anode is greater than 5 mA/sq.ft (or 50 mA/m$^2$). This is much larger than the 0.2–2 mA/sq.ft (or 2–20 mA/m$^2$) that is recommended for zinc anode by NACE International (see "Cathodic Protection of Reinforced Concrete," NACE Report #54286, 1989, page: 47).

Figure 14A:
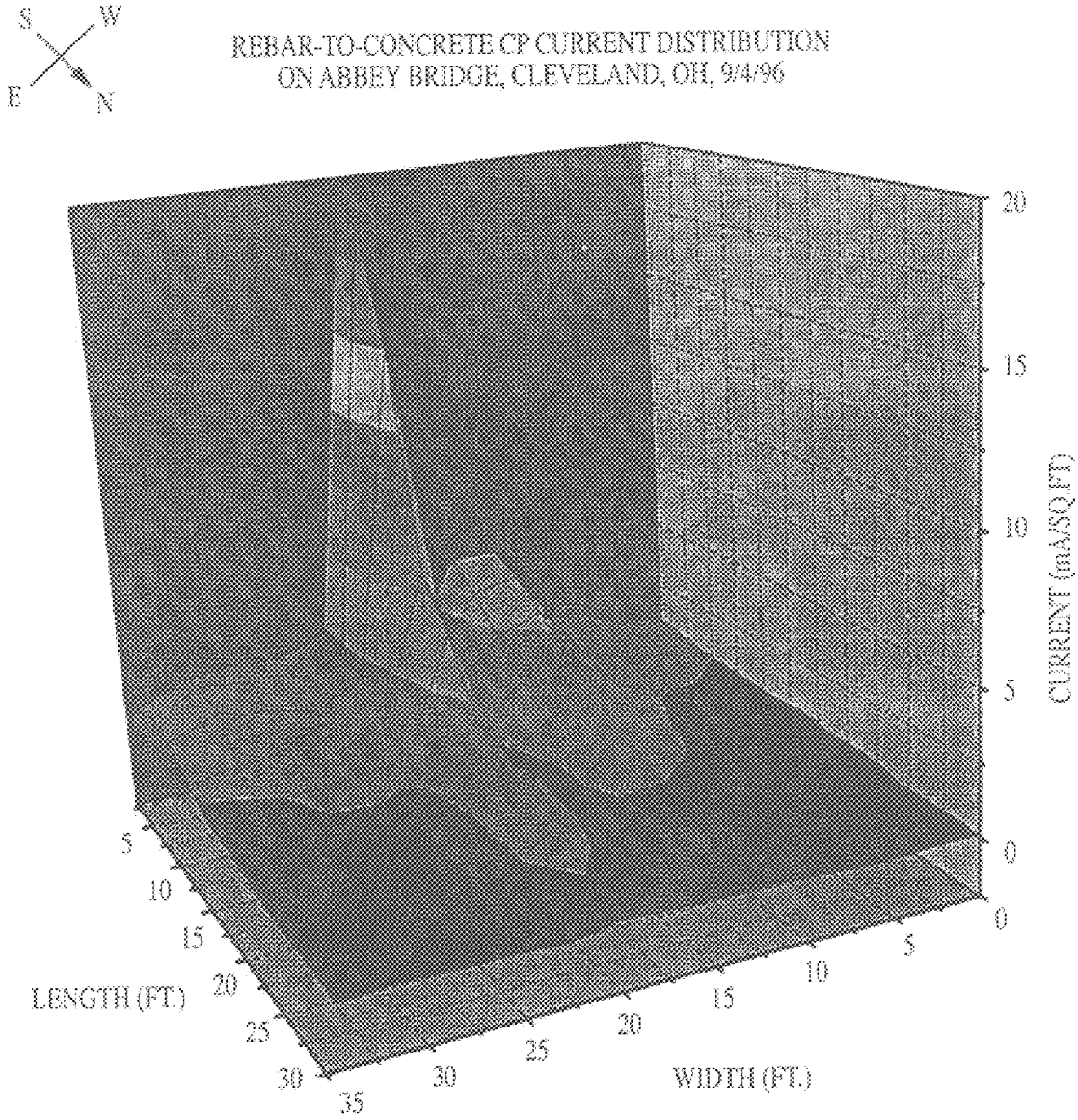
FIG. 14, consisting of FIGS. 14*a*, 14*b*, and 14*c*, illustrates in 14*a*, the rebar-to-concrete cathode protection current distribution of the bridge shown in FIG. 12; in 14*b*, an expanded view of the current distribution of FIG. 14*a* for a section receiving substantially small amounts of current; and in 14*c*, an expanded view of the current distribution of FIG. 14*a* for a section receiving substantially high amounts of current.
Figure 14B:
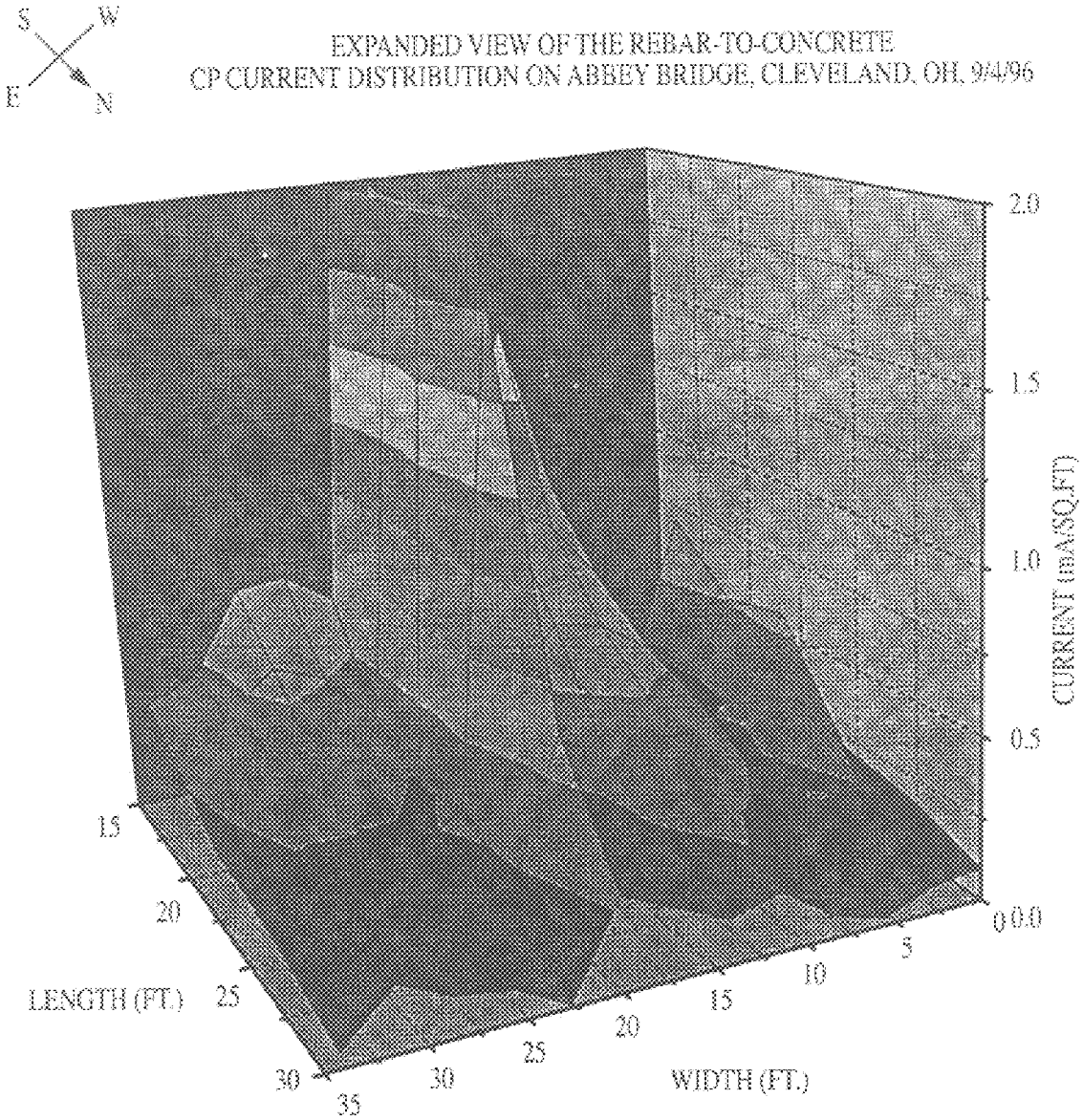
Figure 14C:
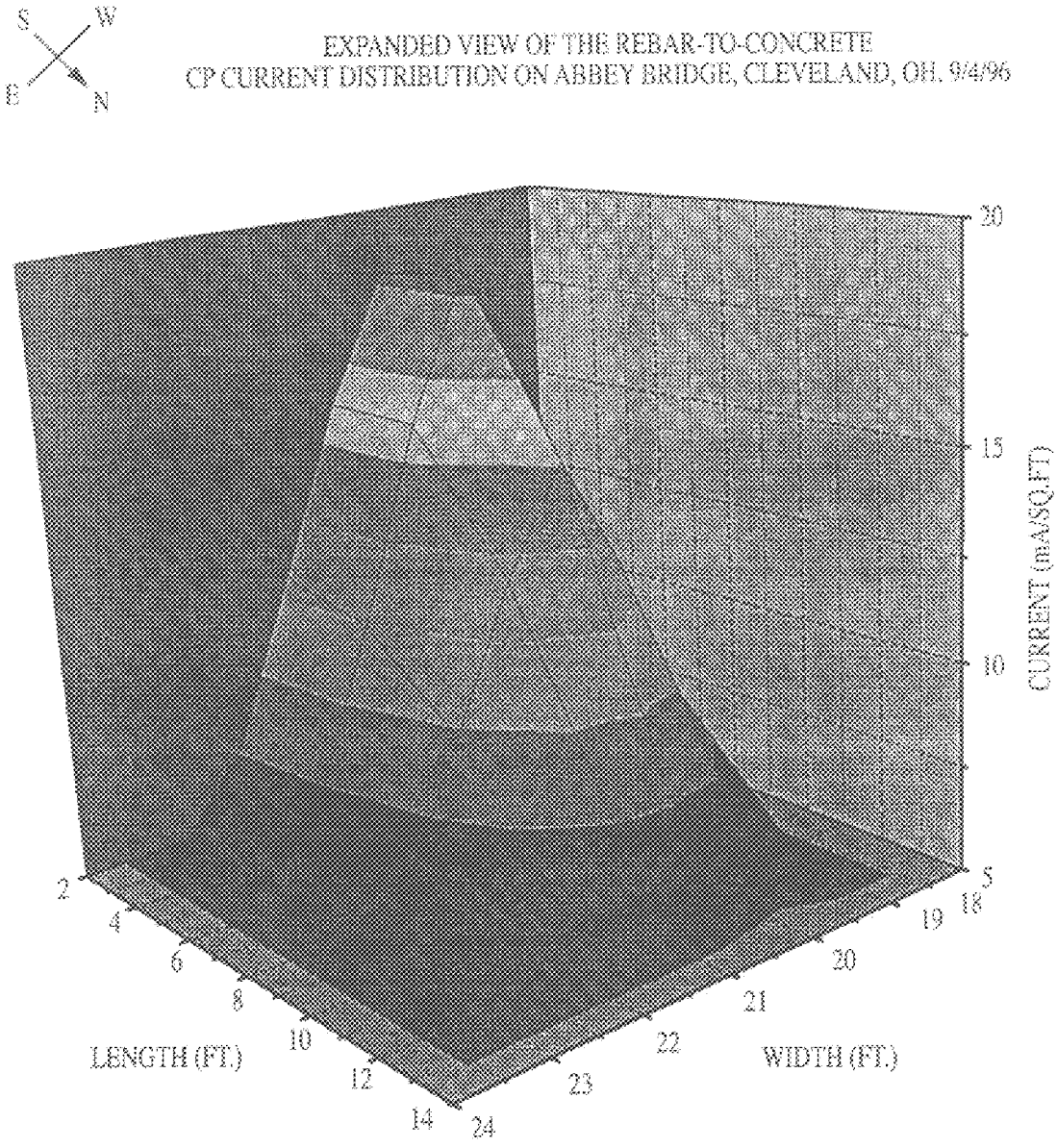

The rebar-to-concrete current distribution is also nonuniform (FIG. 14*a*). The rebars.located over a 60-sq.ft area in FIG. 14*c* receives a relatively large current of 5–20 mA/sq.ft (50–200 mA/m$^2$). Rebars located in the north end of the bridge (which is farther away from the electrical contact points), occupying an area of about 300 sq.ft. (FIG. 14*b*), receive currents that are less than 0.5 mA/sq.ft. (5 mA/m$^2$). As a consequence rebars located in the area shown in FIG. 14*b* should be expected to be corroding at a relatively higher rate compared to the rebars anywhere else in the bridge deck. The rebars in the deck area shown in FIG. 14*c*, should be the least corroding. However, the high current density suggest that they may be most vulnerable to hydrogen embrittlement.

The rebars in Box #9, at a distance of about 10 feet from the south end of the bridge, reportedly experience an unusually large negative polarization. The current density distribution maps suggest that the relative risk due to hydrogen embrittlement at this location is not any higher than at the 10-foot locations (from the south end) in Box #8, 3, and 2. However, the risk due to hydrogen embrittlement appears to be highest with the 0 to 10-foot locations in Box #5 and 6.

The key to the success in cathodic protection is the ability to achieve uniform distribution of current over the entire metal/electrolyte interface. However, this is not easily achieved under field conditions, as can be seen from several published reports on the corrosion status of over 350 bridges in North America that are currently under CP. The reason for the failure of CP in these bridges and—by extension, future bridges—should be critically evaluated in terms of: (1) the uniformity of distribution of the CP current; (2) the design of not only the ground bed vs. rebar geometry, but also the locations of electrical contacts; and (3) the effect of the environmental and climatic factors on the distribution of CP current.

It has been demonstrated that a uniformly distributed ground bed spread over the entire deck does not ensure uniform distribution of the CP current. A magnetometer was used to map the CP current on an in-service bridge in Maryland. In this case, the nonuniformity in the current distribution appears to be due to the improper choice of locations for the electrical contacts. This observation is in complete agreement with the results of an FEM analysis of a rectangular concrete block, which is similar to the deck of the Maryland bridge. By extension, it is possible to optimize and design the electrode configurations for the entire structure through the use of FEM.

In order to ensure proper cathodic protection, the design of a CP system should not only include electrode geometric parameters, but also the spatial and temporal effects of micro-environmental and micro-climatic factors that affect cathodic reaction. In other words, temperature, humidity, wetness, oxygen and chloride concentration, and pH should all be included as a part of the design, maintenance, and management of CP systems. The performance of optimized CP systems can be verified by mapping the CP current with magnetic sensors.

The same sensors can also be used to monitor system performance on a continuous basis. Using magnetometers means that effective feedback controls can be developed to design expert CP systems. Thus, the future designs of cathodic protection ought to be based on sensor-based feedback systems that use microprocessor-controlled rectifiers, i.e., "expert" CP systems.

We claim:

1. A method for designing a cathodic protection system for ensuring a continuous uniform distribution of cathodic protection current throughout an entire structure comprising the step of modeling current and voltage distribution in a proposed structure using a numerical technique.

2. The method as recited in claim 1, wherein the numerical technique comprises the finite element method.

3. The method as recited in claim 2, further comprising the step of verifying the validity of the design of the cathodic protection system by mapping the cathodic protection current in the structure after the structure is built.

4. The method as recited in claim 3, wherein the verifying the validity step comprises the steps of:

sensing the magnetic field generated by the cathodic protection current in the structure;

measuring the sensed magnetic field; and generating a cathodic protection current map using the measured sensed magnetic field.

5. The method as recited in claim 4, wherein the verifying the validity step further comprises the step of interrupting the cathodic protection current at its source.

* * * * *